United States Patent [19]

Seiwatz

[11] Patent Number: 4,668,609

[45] Date of Patent: May 26, 1987

[54] REDUCTION OF DEFLECTION ERRORS IN E-BEAM RECORDING

[75] Inventor: Henry Seiwatz, Wayne, N.J.

[73] Assignee: GAF Corporation, Wayne, N.J.

[21] Appl. No.: 787,946

[22] Filed: Oct. 16, 1985

[51] Int. Cl.[4] ..... G03C 5/00; G03G 13/00

[52] U.S. Cl. ..... 430/296; 430/41; 430/942

[58] Field of Search ..... 430/41, 45, 296, 945, 430/942

[56] References Cited

U.S. PATENT DOCUMENTS

| | | | |
|---|---|---|---|
| 3,867,192 | 2/1975 | Hermans et al. | 117/201 |
| 4,135,926 | 1/1979 | Belli | 96/185 |
| 4,281,050 | 7/1981 | Buckley et al. | 430/41 |
| 4,410,614 | 10/1983 | Lelental et al. | 430/45 |

*Primary Examiner*—John E. Kittle
*Assistant Examiner*—Patrick J. Ryan
*Attorney, Agent, or Firm*—Marilyn J. Maue; Joshua J. Ward

[57] ABSTRACT

In the recording for a mass memory system by means of a plurality of electrostatic electron beam charges on an insulator storage medium comprising a dielectric material having a maximum secondary electron emission coefficient ($\delta_{max}$) greater than one as a surface layer disposed on a conductive support the process of recording the individual transmission of charges at three distinguishable energy levels which provide uncharged spots and alternating negative and positive electrostatic charges in the pixels of the dielectric layer which alternating charges are effected by employing a primary beam energy greater than the lowest energy and less than the highest energy at which the secondary electron emission coefficient ($\delta$) is unity for a positive charge and employing a primary beam energy less than the lowest energy or greater than the highest energy at which $\delta$ is unity for a negative charge.

14 Claims, 1 Drawing Figure

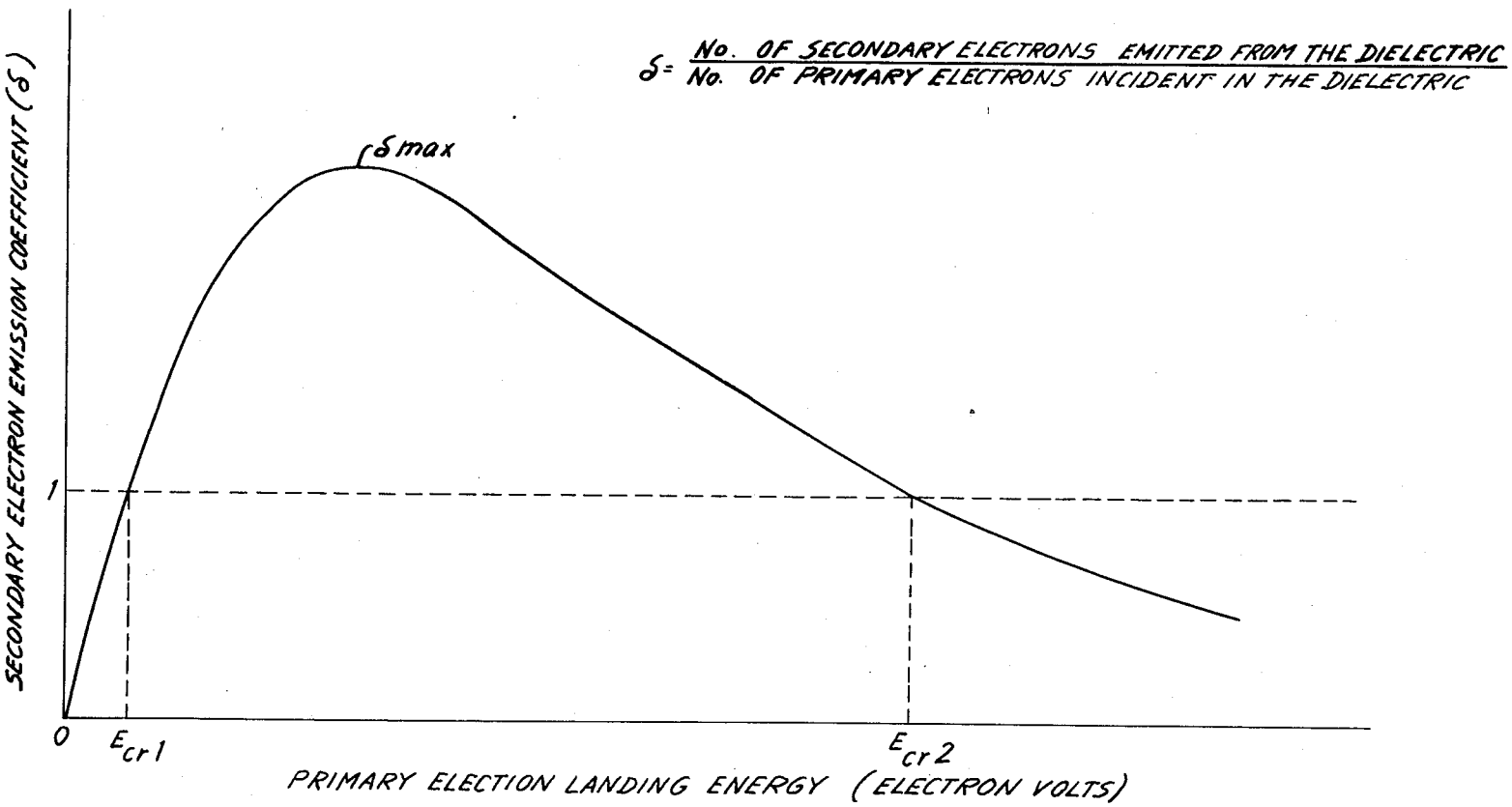
δ = No. OF SECONDARY ELECTRONS EMITTED FROM THE DIELECTRIC / No. OF PRIMARY ELECTRONS INCIDENT IN THE DIELECTRIC
δmax
1
0
Ecr1
Ecr2
PRIMARY ELECTION LANDING ENERGY (ELECTRON VOLTS)
SECONDARY ELECTRON EMISSION COEFFICIENT (δ)

REDUCTION OF DEFLECTION ERRORS IN E-BEAM RECORDING

This invention relates to mass memory recording by a particular and improved method for writing information in the surface of a mass memory dielectric insulator by means of an electrostatic charge from an electron beam exposure system which includes a source for generating the beam, an electron optical system for focusing the beam on the insulator medium or substrate and means for moving the beam and the substrate relative to each other in directions transverse to the beam access. The recording is used to store transmitted information for subsequent readout with an electron beam scanning device.

Recording with an electron beam recording system on an insulator presents several problems, among which, the deflection of the beam away from its desired address point due to a previously deposited charge, is prominent. Specifically, when a substantial area of the insulator has been recorded with charge of one polarity, additional recording in immediate proximity to the recorded area with a similar charge tends to deflect the E-beam, and the charge on impact will be directed away from the pre-recorded portion or area of resident charge by the aggregate or concentration of electrons contained therein which repulse the incoming beam. Similarly, when an incoming charge of opposite polarity is employed, the beam and charge on impact will be directed toward the pre-recorded area of the resident charge. Such deflections on the incoming charge lead to inaccurate recording and loss of resolution.

Accordingly, it is an object of the present invention to minimize or substantially obviate the above problems in a convenient and economically feasible manner.

Another object of this invention is to provide a recording on a dielectric medium having high accuracy and sharp resolution.

Another object is to provide an improved mas memory recording which permits higher packing density.

Yet another object is to extend the lifetime of the recording on the medium.

Still another object is the ability to record intricate patterns.

These and other objects will become apparent from the following description and disclosure.

BRIEF DESCRIPTION OF DRAWING

The FIGURE is a schematic representation of the dependence of the secondary electron emission coefficient upon the primary electron landing energy.

Essentially this invention involves the use of a high intensity electron beam source for transmitting primary electrons as precise discrete charges in a narrow beam and at a low energy onto a recording medium containing a dielectric insulator layer capable of receiving and containing the discrete transmitted charges. The electron beam source is one which includes a cathode of tungsten, or, preferably, zirconium impregnated tungsten, and an electron optical system to direct the primary electron beam onto the surface of the recording media at a low energy sufficient to penetrate and be retained in the dielectric layer. An electron thermal field emitter is a particularly desirable source since it is capable of providing in excess of 100 nonoamperes of beam current, which, at accelerating potentials in the range of 7 to 15 KV, can be focused onto a spot as small as 0.1 micrometers. The same electron beam apparatus used for transmitting primary electrons in writing a pattern on the recording medium can also be employed for reading the pattern of charged spots or bits transmitted to the dielectric insulator layer of the recording medium. Reading is accomplished by analyzing the secondary electrons emitted from the surface of the dielectric layer, passing these through an electron energy analyzer followed by an electron multiplier, the signal from which is transmitted to a cathode ray tube, print-out device or into a computer for reformation.

Although tungsten or zirconium enriched tungsten are preferred cathodes for the present system, other cathode materials can be employed. Zirconium enriched tungsten is particularly desirable because of its long cathode life; for example, more than 5,000 hours of use has been achieved. The electron beam source employing this cathode has the ability to direct a narrow beam of electrons into a diameter significantly smaller than that of the desired spot of charge to be deposited near the surface of the dielectric recording layer.

For the purposes of this invention, the recording medium is an insulator having a maximum secondary electron emission coefficient ($\delta_{max}$) greater than one, preferably greater than 1.5, a molecularly homogeneous structure, a long charge retention time with minimal decay under its own electrostatic field and a dielectric strength sufficient to support about 5 to 10 volts across the thickness of the insulator. Such properties are found in saturated aromatic polymers, such as for example polystyrene, and in perhalogenated aliphatic polymers such as the fluorinated or chlorofluorinated olefinic polymers, e.g. Teflon-like polymers of which tetrafluoroethylene and chlorotrifluoroethylene polymers are representative. An insulating layer composed of these polymers has a charge retention time from about 130 to about 850 days.

The dielectric insulator is disposed in a layer or coating on a conductive substrate or electrostatic ground which is in the form of a smooth, flat metallic sheet or metallic sheet backed by a smooth flat substrate. To prevent distortion of the recorded information, the metallic sheet must be flat over a substantial area of pixels on the dielectric insulator surface. Techniques for applying thin films of dielectric on a conductive surface are well known and include spin coating and plasma polymerization. The thickness of the conductive substrate is greater than about 0.01 micrometers, preferably greater than about 0.05 micrometers. There is no functional upper boundary for the conductive layer since electrically it makes no difference. The selected thickness of the dielectric layer depends primarily on the energy of the primary beam addressing the recording medium and on the type and location of information to be transmitted. In accordance with these variables, the insulator layer is preferably deposited in the thickness of between about 0.05 and about 1.0 micrometer. However, thicknesses of between about 0.01 and about 10 micrometers can also be employed.

In operation, the electron beam transmits a pattern of data by imposing individual charges as primary electrons in discrete areas or spots in the insulating layer of the recording medium. The electron emitter is unblanked and blanked to charge and leave uncharged spots or pixels in the insulating layer so that, upon completion, the information recorded is a replica of the pattern to be transcribed and is recorded in an arrangement of charged and uncharged spots which may or may not be arranged in alternating pattern. Each spot or pixel of the conductive layer represents an area of between about 0.05 and about 2 micrometers, preferably between about 0.1 and 1.0 micrometers, in diameter and is developed by an electron beam of somewhat smaller diameter, for example from about 0.01 to about 1.8 micrometers.

Heretofore charges in a binary system were transmitted at an energy level of between about 100 and about 450 eV, preferably between about 175 and about 275 eV, which deposited a positive charge on the insulating layer. This positive charge results when the incoming primary beam is of such energy that an average of more than one secondary electron is emitted from the insulating layer for each primary electron penetrating and deposited therein. However, problems in transmitting and reading information by this conventional method arise when a substantial area of the dielectric has been recorded to a macroscopically uniform charge density with charges of the same polarity. Specifically, for such unipolar recording, the primary electron beam directed to the surface of the dielectric layer is subject to the influence of charges previously deposited so that an attraction or repulsion (when the recording consists of negative charges) of the incoming charge is effected. This net attraction or repulsion exerted by a prerecorded area changes the precise positioning of the incoming charge and causes a degree of inaccuracy in the reading of the pattern transmitted by the secondary electrons ejected from each precise spot. The location and degree of placement error in the dielectric layer depends upon the charge distribution and density of the prerecorded area and the proximity of the charge entering the recorded area. Additionally, the attracting or repelling movements have the effect of decreasing the resolution of the pattern subsequently transcribed.

The present invention is based on qualitative observations and arguments. Qualitatively, gross distortion of an image has been observed when recording with unipolar charge. Although this effect can be somewhat diminished when the charge density, and hence the surface potential, is reduced, further improvement in this area is greatly desired. By the process described herein, an average surface potential closely approaching zero can be obtained.

According to the present invention the above difficulties encountered in a binary system are obviated by alternating negative and positive discrete charges in the pixels of the recording media. This is accomplished by using a 3 level recording method, i.e., alternating positively and negatively charged spots, where each charged spot, whether positive or negative, represents a logical unity. Thus, where before one or a series of positively charged pixels were followed by one or more uncharged spots, the present invention alternates plus and minus charges of the pixel units with intervening uncharged spots. Accordingly, a logical sequence 1,1,1,0,1,1,0,0,0,1 may be altered to appear as $$+1,-1,+1,0,-1,+1,0,0,0,-1,$$

which is representative of the alternating effect. However, it should be understood that any other pattern of uncharged spots and alternating plus and minus charges is also contemplated and is within the scope of this invention. By alternating the polarity of charges while recording the pattern of information, the repulsion or attraction effect displacing the exact positioning of the incoming primary electron charge is nearly obviated or substantially minimized. Accordingly, upon reading the recorded information, the pattern transmitted is more accurate and possesses higher resolution.

The primary electron beam transmits the electron charge entering the system from an electron gun and electron optical system for focusing the beam prior to impingement on the insulator. The primary electrons entering the insulator layer encounter a cloud of electrons surrounding a polymer molecule. As a result of this contact some of the electrons are ionized and displaced and sufficient energy is transmitted in some cases to eject an electron from the surface of the dielectric insulator. The ejected electrons are termed secondary electrons and, on readout, are accelerated away from the insulator surface by an electrostatic field and formed into a return beam. In the readout system, the secondary electrons collected by the electrostatic field are separated according to their energies, the three charge levels are identified and the original pattern representing the impressed logical sequence is replicated.

When more secondary electrons are ejected than are deposited by the primary electrons, the spot of the dielectric carries a positive charge. However, when fewer secondary electrons are ejected than there are primary electrons entering, the spot of the dielectric carries a negative charge.

Reference is now had to the accompanying drawing which represents schematically the manner in which the secondary electron emission coefficient depends upon the primary electron energy for insulating materials which are suitable as recording media for the purpose of this invention. The designations $E_{cr1}$ and $E_{cr2}$ represent the primary energies at which the secondary electron emission coefficient ($\delta$) curve intersects the unity line, indicated by the numeral 1. The maximum value of $\delta$ is indicated as $\delta_{max}$. For primary electron energies between $E_{cr1}$ and $E_{cr2}$, the insulating material will be charged positively. For primary electron energies below $E_{cr1}$ or above $E_{cr2}$, the insulating material will be charged negatively. As an example, for an insulating polystyrene resin, it has been found that $E_{cr1}$ is 18 eV, $E_{cr2}$ is 1060 eV, and $\delta_{max}$ is 2.17 at a primary electron energy of 240 eV. As a second example, for a polytetrafluoroethylene resin, it has been found that $E_{cr1}$ is 37 eV, $E_{cr2}$ is 1150 eV, and $\delta_{max}$ is 1.86 at a primary electron energy of 253 eV. Considering this latter example of an insulating recording medium, a most preferred embodiment would be to charge negatively by using primary electron energies in the range 15–35 eV or 1160–1200 eV and to charge positively by using energies in the range 40–100 eV or 1000–1145 eV. Depending on the energy levels at which $\delta$ is unity for a specific recording medium selected, these ranges of energy may vary. Generally, it is most preferred in the operation of the present invention to employ primary beam energy levels as close to the condition of unity $\delta$ as practical without actually achieving unity $\delta$, at least about 4% above or below unity $\delta$ is desirable.

In practice, the primary beam energy is chosen to provide a value of $\delta$ such that the product of the primary beam current and the quantity $(\delta-1)$ provides the charging or recording current desired for a particular application. It is to be understood that for any given dielectric material having a $\delta_{max}$ greater than 1, there is a range of applicable primary beam energy which is specific to that dielectric, in which a positive charge can be deposited. Similarly, there is a range of applicable primary beam energy which is specific to that dielectric, in which a negative charge can be deposited.

Thus, transmission of + and − electrostatic charges in the insulating layer of the recording medium is achieved by increasing and decreasing the energy level at which primary electrons impact on the surface of the dielectric. Broadly, for deposition of a negative charge, the electron beam energy must be either less than the lowest energy at which the secondary electron emission coefficient, δ, is unity or greater than the highest energy at which δ is unity for the dielectric selected. Conversely, for deposition of a positive charge, the electron beam energy must be greater than the lowest energy at which δ is unity and less than the highest energy at which δ is unity. For example, an electron beam energy between about 40 and about 1050 eV for a positive charge and a low beam energy of between about 12 and about 16 eV or a high beam energy between about 1155 and about 2,000 eV for a negative charge are operable ranges for both the polystyrene and polytetrafluoroethylene resins of the invention.

Having generally described the invention, reference is now had to the following examples which illustrate preferred embodiments thereof but which are not to be construed as limiting to the scope of the invention as set forth hereinabove and in the appended claims.

EXAMPLE 1

A mass memory storage medium is made up of three layers. The first layer is a flat glass substrate one inch square and 0.048 inches thick. Upon this substrate is sputtered a second layer, consisting of chromium approximately 0.05 micrometers thick. The third layer is a polystyrene resin which is deposited on the chromium-coated substrate by spin-coating to a thickness of approximately 0.62 micrometers. The storage medium is placed in a sample holder positioned below the electron optical column of a scanning electron microscope (SEM) functioning as an electron beam recording device. A retarding field spectrometer is positioned between the electron optical column of the SEM and the sample holder to permit reading out of recorded charge levels by analyzing the energies of the secondary electrons emitted from the storage medium. The electron beam is blanked and addressed digitally under external computer control.

CASE A

For test purposes, a checkerboard data pattern approximately 200 micrometers square, with a pixel size of about 0.8 micrometers is recorded on the storage medium. The electron beam landing energy is about 1220 electron volts, and the corresponding secondary electron emission coefficient, δ, for this material is about 0.9. The dwell time, or unblanking time, on each pixel is chosen so that the charge deposited on each recorded pixel, given by the product of the primary beam current (about 20 picoamperes), the dwell time, and the quantity $(\delta-1)$, is sufficient to produce a potential of about −20 volts. The test pattern is read out using the secondary electron energy analyzer. The result is displayed on the SEM, photographed, and evaluated with respect to resolution, distortion and noise level. Considerable distortion is observed in this case, particularly at the edges of the pattern.

CASE B

The conditions and test procedures are the same as in Case A, except that the dwell time is reduced by a factor of 2 and the charge level is now sufficient to produce a potential of about −10 volts. The readout indicates less distortion and noise, and greater resolution, than in Case A.

CASE C

The conditions and test procedures are the same as in Case B, except that each time the beam is unblanked to record on a pixel, a flip-flop is triggered to change its state. This flip-flop controls the electron beam landing energy. In one state, the landing energy is 1220 electron volts, as in Cases A and B. In the alternate state, the landing energy is 940 electron volts, and the corresponding value of δ for this material is about 1.1. In the first state, the pixel is charged negatively; in the second state, positively. In both states, the magnitude of the charge density is about the same. The readout circuitry interpretes either a positively or negatively charged pixel as a logical ONE; an uncharged pixel is interpreted as a ZERO. The display of the readout in this case indicates considerable improvement with respect to distortion, noise level and resolution, compared to Case B and even greater improvement over Case A.

EXAMPLE 2

The storage medium in this example is the same as in Example 1, except for the third layer, which is a polytetrafluoroethylene resin, deposited on the chromium-coated substrate by a process of plasma polymerization to a thickness of about 0.42 micrometers. The mechanical configuration is the same as in Example 1.

CASE A

As in Example 1, a checkerboard data pattern approximately 200 micrometers square, with a pixel size of about 0.8 micrometers, is recorded on the storage medium. The electron beam landing energy is about 47 electron volts and the corresponding value of δ for this material is about 1.1 The dwell time on each pixel is chosen so that the amount of charge deposited is sufficient to produce a potential of about +10 volts. The test pattern is read out using the same apparatus and procedure used in Case B of Example 1. The results are comparable to those observed in that case and are noted for comparison to Case B of this example.

CASE B

The conditions and test procedures are the same as in Case A of this example, except that each time the beam is unblanked to record a pixel, the flip-flop referred to in Case C of Example 1 is triggered to change its state and hence the electron beam landing energy. In one state, the landing energy is about 47 electron volts, as in Case A immediately above. In the alternate state, the landing energy is about 27 electron volts and the corresponding value of δ for this material is about 0.9. In the first state, the pixel is charged positively; in the second state, negatively. In both states, the magnitude of the charge density is about the same. The readout circuitry interpretes either a positively or negatively charged pixel as a logical ONE; an uncharged pixel as a ZERO. The display of the readout indicates substantial improvement with respect to distortion, noise level and resolution, as compared to the readout in Case A of this example.

From the above examples and general discussion of the drawing, many variations and modifications of this invention, particularly with respect to alternative insulator resins and layer thickness of said resins, as well as thicknesses and alternative conductive support members, will become apparent to those skilled in this art; however, these variations and modifications are included within the scope of this invention.

What is claimed is:

1. In a mass memory process for recording information by means of a plurality of electrostatic electron beam charges on an insulator film storage medium comprising a dielectric material having a secondary electron emission coefficient greater than one as a surface layer disposed on a conductive support, the improvement which comprises: recording the individual transmission of charges at three distinguishable energy levels which provides uncharged spots and alternating negative and positive electrostatic charged spots in the pixels of the dielectric insulator layer.

2. The process of claim 1 wherein the pixels of the dielectric insulator layer are charged positively with an electrom beam energy where said beam energy is greater than the lowest energy at which $\delta$ is unity and less than the highest energy at which $\delta$ is unity and wherein said pixels of the dielectric layer are charged negatively with an electron beam energy where said beam energy is less than the lowest energy at which $\delta$ is unity or where said beam energy is greater than the highest energy at which $\delta$ is unity.

3. The process of claim 2 wherein said beam energies employed are at least 4% divergent from unity $\delta$.

4. The process of claim 1 wherein the dielectric material is polystyrene or polytetrafluoroethylene and the electron beam transmissions of primary electrons closely approach, but are divergent from, the condition of unity $\delta$.

5. The process of claim 1 wherein the insulator film storage medium comprises a substrate layer superimposed by a conductive layer which is coated in a thickness of between about 0.01 and about 1.5 micrometers with the non-conductive dielectric layer and wherein the negative and positive charges are trapped within said non-conductive dielectric layer.

6. The process of claim 1 wherein said non-conductive dielectric layer is composed of an organic polymer resin.

7. The process of claim 6 wherein the organic polymeric resin is polystyrene.

8. The process of claim 6 wherein the organic polymeric resin is Teflon.

9. The process of claim 1 wherein the dielectric material is polystyrene and the electron beam transmissions of primary electrons are effected at from about 20 to about 25 eV or from about 1045 to about 1055 eV for a positive charge and from about 10 to about 16 eV or from about 1065 to about 1075 eV for a negative charge.

10. The process of claim 1 wherein the dielectric material is polytetrafluoroethylene and the electron beam transmissions of primary electrons are effected at from about 40 to about 50 eV or from about 1135 to about 1145 eV for a positive charge and from about 25 to about 35 eV or from about 1155 to about 1175 eV for a negative charge.

11. The process of determining $\delta$ for the dielectric material of claim 1 according to the equation $$\delta = \frac{\text{Number of secondary electrons emitted from the dielectric}}{\text{Number of primary electrons incident in the dielectric}}$$

and then charging the pixels of the dielectric resin according to the process of claim 1.

12. The process of claim 1 wherein the dielectric material has a $\delta_{max}$ greater than 1.5.

13. The process of claim 1 wherein the dielectric material is a layer having a thickness of between about 0.01 and about 10 micrometers.

14. The process of claim 1 wherein the dielectric material is a layer having a thickness of between about 0.05 and about 1 micrometer.

* * * * *